US005816421A

United States Patent [19]

Clodfelter et al.

[11] Patent Number: 5,816,421

[45] Date of Patent: Oct. 6, 1998

[54] CLOSURE CAP HAVING AN UNPLEASANT TASTING COATING

[75] Inventors: Christopher Clodfelter; Gary V. Montgomery, both of Evansville, Ind.

[73] Assignee: Rexam Plastics, Inc., Evansville, Ind.

[21] Appl. No.: 851,905

[22] Filed: May 6, 1997

[51] Int. Cl.[6] ..... B65D 50/00

[52] U.S. Cl. ..... 215/201; 215/365; 215/DIG. 2; 116/200; 206/459.5

[58] Field of Search ..... 215/365, 367, 215/201, 225, 329, 400, DIG. 2; 220/288; 206/534, 459.5; 426/87, 132, 134; 428/905; 116/200, 205, 214

[56] References Cited

U.S. PATENT DOCUMENTS

| | | | |
|---|---|---|---|
| 2,116,310 | 5/1938 | Harvey | 426/134 |
| 2,620,227 | 12/1952 | Iwase et al. . | |
| 3,042,532 | 7/1962 | Daline | 426/132 |
| 3,757,979 | 9/1973 | Berghahn | 215/225 |
| 3,863,797 | 2/1975 | Berghahn | 215/225 |
| 4,535,906 | 8/1985 | Rowekamp | 215/329 |
| 4,616,759 | 10/1986 | Mahler | 215/329 |
| 5,474,093 | 12/1995 | Pettiet . | |

*Primary Examiner*—Allan N. Shoap
*Assistant Examiner*—Nathan Newhouse
*Attorney, Agent, or Firm*—Middleton & Reutlinger; Charles G. Lamb

[57] ABSTRACT

A closure cap includes a top wall with recesses therein wherein the recesses have an unpleasant tasting material therein to discourage infants and small children from placing the closure caps in their mouths and biting down on the caps.

6 Claims, 1 Drawing Sheet

CLOSURE CAP HAVING AN UNPLEASANT TASTING COATING

BACKGROUND OF THE INVENTION

This invention relates to unpleasant tasting coatings on closure caps and more particularly to a closure cap having an unpleasant tasting material thereon to prevent small children from placing the closure in their mouths and biting down on the closure cap.

Infants and other young children are curious in nature and all objects to which they come in contact with are susceptible for being fondled and if small enough find their ways into their mouths. In the case of small containers, infants will place these containers in their mouths and bite down. In many cases the biting down destroys the integrity of the container or its cap thereby providing access to the materials contained within the containers. Containers containing drugs and other materials which are harmful to infants and small children provide problems for container and cap manufacturers. Thus, there is an ever present need to make container products and particular closure caps which have means thereon to prevent access into the container by biting into or off the closure cap.

SUMMARY OF THE INVENTION

It is an object of the present invention to provide a closure cap for containers having an unpleasant tasting material on the closure cap.

It is another object of the present invention to provide a closure cap for a container having a top wall with means to receive an unpleasant tasting material disposed therein.

More particularly, the present invention provides a container cap comprising: a top wall with means to receive an unpleasant tasting material thereon; an unpleasant tasting material disposed on said top wall; a cylindrical sidewall extending downwardly from said top wall; and, attaching means in cooperating relation with said sidewall for attaching the cap to a container.

It will become apparent that other objects and advantages of the present invention will be obvious to those skilled in the art upon reading the detailed description of the preferred embodiment set forth hereinafter.

DESCRIPTION OF THE PREFERRED EMBODIMENT

Figure 2:
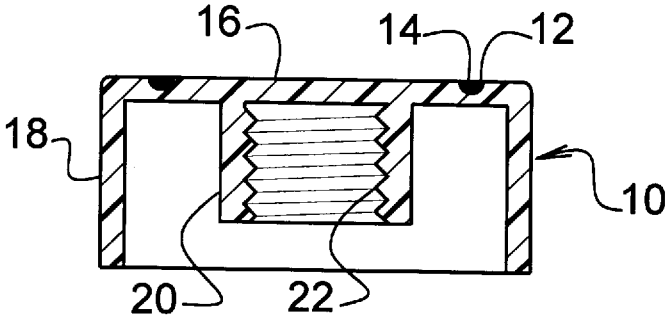
FIG. 2 is a sectional view of the closure cap of FIG. 1 taken along the lines 2—2 of FIG. 1.

As shown in the figures, a closure cap 10 of the present invention is provided with a top wall 16 and at least one downwardly extending sidewall. As shown in FIG. 2, closure cap 10 is provided with an outer sidewall 18 and an inner sidewall 20 spaced from the outer sidewall 18, each sidewall extending downwardly from the top wall 16. The inner sidewall 20 is provided with threads 22 for mating relation with a container to which the closure cap 10 may be attached. Even though two sidewalls are shown, it is realized that only one sidewall having attaching means, such as threads 22, are necessary but in many practical applications a cap having an outer sidewall, such as that identified by numeral 18, and an inner sidewall, such as that identified by numeral 20, are preferred.

Figure 1:
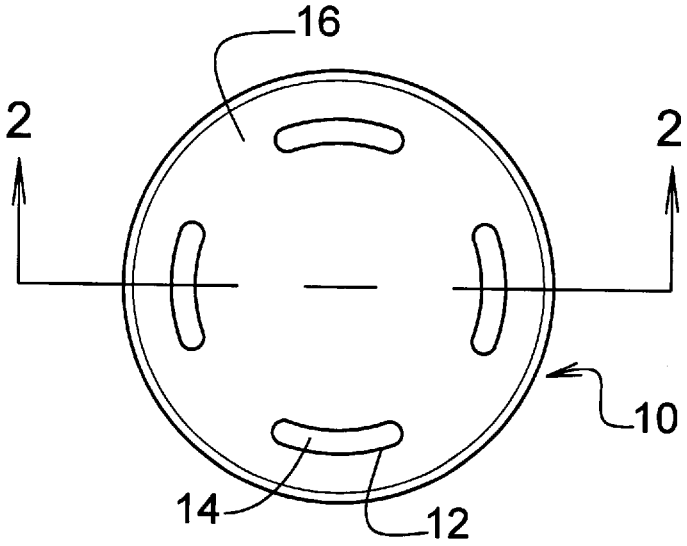
FIG. 1 is a top view of a preferred embodiment of a closure cap of the present invention.

The top wall 16, as best shown in FIG. 1, includes means to receive an unpleasant tasting material. In a preferred embodiment, the means to receive the unpleasant tasting material is a plurality of recesses therein, the recesses being exemplified as grooves 12. In the grooves 12 is placed the unpleasant tasting material. One such material is a bitter tasting material 14, such as Bitrex® which is a denatonium benzoate product of MacFarlan Smith, LTD. Bitrex® is bitter tasting and does not provide any harmful effects to small children. Other unpleasant or bitter tasting materials, such as sucrose octa-acetate or other ascorbic compounds or agents may also be utilized. Cayenne pepper is another example of an unpleasant tasting material that may be used in the present invention. The criteria for determining the unpleasant tasting material to be used in the present invention is that it can be easily applied to the recesses in the top wall 16 and that the unpleasant tasting material will not be harmful to infants or other small children.

The unpleasant tasting material is usually mixed with an appropriate solvent for brushing or spraying onto the top wall 16 and into the grooves or recesses 12. In many instances, a varnish or shellac is used so as to provide a hard covering with the unpleasant tasting material encapsulated therein. In the use of Bitrex® , the Bitrex® is usually used in a range of from 20 to 50 parts per million in a solvent-lacquer solution when applied to top wall 16.

While the invention has been found in one preferred embodiment in respect to the design of a closure cap for specific compositions of unpleasant tasting materials and the use thereof to discourage ingestion by small children, it is apparent that various modifications can be made to the present invention without departing from the spirit or scope of the invention as set forth in the claims appended hereto.

What is claimed is:

1. A closure cap to prevent a child from placing the cap in the mouth comprising:

a top wall with at least one recess to receive an unpleasant tasting material therein;

an unpleasant tasting material disposed within said recess to produce an unfavorable taste causing the removal of the cap from the mouth;

a cylindrical sidewall extending downwardly from said top wall; and, attaching means to said sidewall for cooperating with mating attaching means on a neck of a container.

2. The closure cap to prevent a child from placing the cap in the mouth of claim 1, said recess being a plurality of recesses.

3. The closure cap to prevent a child from placing the cap in the mouth of claim 1, said recess being a plurality of grooves in said top wall at preselected locations therearound.

4. The closure cap to prevent a child from placing the cap in the mouth of claim 1, said unpleasant tasting material including denatonium benzoate.

5. The closure cap to prevent a child from placing the cap in the mouth of claim 1, said attaching means in said sidewall being threadable attaching means.

6. The closure cap to prevent a child from placing the cap in the mouth of claim 1, the cylindrical sidewall including an outer sidewall and an inner sidewall spaced from said outer sidewall, said inner sidewall having an inner surface with threadably attaching means therealong.

* * * * *